United States Patent [19]

Infield et al.

[11] 4,162,686

[45] Jul. 31, 1979

[54] INDUSTRIAL BOILER UTILIZING MULTIPLE FUELS AND HAVING REDUCED PARTICULATE EMISSION AND METHOD OF COMBUSTION

[75] Inventors: Harold B. Infield, Garfield Heights, Ohio; Albert Morrison, III, Landisville; William A. Tauskey, Sr., Bradford Woods, both of Pa.

[73] Assignees: North American Manufacturing Company, Cleveland, Ohio; Burnham Corporation, Irvington, N.Y.; Combustion Service and Equipment Corporation, Pittsburgh, Pa.

[21] Appl. No.: 842,467

[22] Filed: Oct. 17, 1977

[51] Int. Cl.[2] ..... F23C 1/02; F22B 7/12

[52] U.S. Cl. ..... 122/149; 110/260; 122/22

[58] Field of Search ..... 110/260, 261; 122/22, 122/149, 211

[56] References Cited

U.S. PATENT DOCUMENTS

| | | | |
|---|---|---|---|
| 237,504 | 2/1881 | Dudley et al. | 110/260 |
| 740,323 | 9/1903 | Simms | 110/260 |
| 749,586 | 1/1904 | Simms | 110/260 |
| 815,574 | 3/1906 | Wilson | 110/260 |
| 951,069 | 3/1910 | Forsyth | 110/260 |
| 1,113,379 | 10/1914 | Stedman | 110/297 |
| 1,115,672 | 11/1911 | Hoffman | 110/260 |
| 1,118,137 | 11/1914 | Koerting | 110/342 |
| 1,805,634 | 5/1931 | O'Connor | 110/260 |
| 1,840,306 | 1/1932 | Beecher | 110/261 |
| 1,929,424 | 10/1933 | Heaton | 110/261 |
| 3,463,599 | 8/1969 | Welty | 110/344 |

FOREIGN PATENT DOCUMENTS

| | | | |
|---|---|---|---|
| 366531 | 1/1923 | Fed. Rep. of Germany | 110/260 |
| 24224 | of 1913 | United Kingdom | 110/260 |

OTHER PUBLICATIONS

Three Fuel Model '64 Boiler published by Combustion Service and Equipment Co. of P. H. Penn.

Industrial Boilers, Power Magazine, Feb. 1977.

*Primary Examiner*—Kenneth W. Sprague

*Attorney, Agent, or Firm*—Haynes N. Johnson

[57] ABSTRACT

A multi-fuel boiler is provided in which coal is burned in combination with oil or gas in such manner that the particulate emission from the coal, normally relatively high, is reduced to a level comparable to oil. In one example, coal of a quality that would normally burn with a Bacharach smoke spot test number of 6 can be burned with a test number below 2.

This is accomplished by utilization of a horizontal oil or gas flame directed across the flue gas exit of the combustion chamber in opposition to the flow of coil combustion gases to change the normal flow pattern of the combustion gases. This creates turbulence, which provides additional combustion time at combustion temperatures in the presence of excess air. Efficiency in particulate removal increases with increased use of oil or gas, but has been found to reach its most efficient, asymptotic point with no more than about 25% to 30% of oil relative to the total input (on a BTU basis), after which the addition of additional oil or gas does not increase particulate removal. At this point the boiler will have the clean burning characteristics of oil, but will be using 70% to 75% coal.

10 Claims, 6 Drawing Figures

INDUSTRIAL BOILER UTILIZING MULTIPLE FUELS AND HAVING REDUCED PARTICULATE EMISSION AND METHOD OF COMBUSTION

FIELD OF THE INVENTION

This invention relates to industrial boilers which burn coal primarily, but have a low particulate emission of the order of magnitude normally achieved through the burning of oil. The boiler is of the simultaneous firing type in which oil or gas is burned simultaneously with coal, creating reduced particulate emission.

Though simultaneously-firing multi-fuel boilers are old, they do not appear to provide for a high temperature area of increased turbulence and time delay, at elevated temperatures, prior to the flue gas exit of the combustion chamber to give greater efficiency.

SUMMARY OF THE INVENTION

The present invention is an industrial boiler for production of steam or hot water in which the primary fuel is coal. A lesser quantity of secondary fuel, oil or gas, is burned in a substantially horizontal flame which passes across and counter to the normal flow of combustion gases from the coal bed to the flue gas exit of the combustion chamber. The oil or gas flame crosses the coal combustion gas path and so disrupts it. This produces turbulence thus creating exiting delay, at elevated combustion temperatures (from the oil or gas flame), and so produces more complete combustion of any particulate matter in the coal combustion gases.

The boiler includes a combustion chamber below a fire-tube section. The combustion chamber includes a coal bed in a coal-burning area beneath a major portion of the fire-tube section with a front loading stoker, and a flue gas exit to the first fire-tube pass at the rear of the chamber beyond the bridge wall. An oil or gas burner is mounted in the rear wall of the combustion chamber, positioned such that its flame extends horizontally over the top of the bridge wall and past the flue gas exit. Consequently, the flame crosses the path of the coal combustion gases going from the coal bed to the flue gas exit. This flame should be of sufficient force to create turbulence, the gases being diverted and directed away from the exit, thus providing more time for combustion, in the presence of combustion temperatures from the oil or gas flame.

A fire-tube section is directly above the combustion chamber and so receives heat not only through multiple fire-tube passes, but also from the hot combustion gases passing below the crown.

The invention includes a boiler adapted to burn coal with reduced particulate emission, said boiler including a combustion chamber and a fire-tube section, said combustion chamber positioned below said fire-tube section and having a flue gas exit at one end thereof to discharge hot combustion gases from said combustion chamber, said combustion chamber including a coal-burning area and an oil or gas burner, said coal-burning area not being directly beneath said flue gas exit, whereby passage of coal combustion gases from said coal-burning area is at an angle from the vertical through a combustion gas passage, said burner being positioned at the opposite end of said combustion chamber from said coal-burning area and below and proximate to said flue gas exit, said burner being directed so that its flame extends horizontally through said combustion gas passage toward the end of the combustion chamber having said coal-burning area, past said flue gas exit, and across the path of said coal combustion gases, and means for varying the relative quantities of coal and oil or gas being burned, whereby the direction of the flame from said burner opposes the direction of said coal combustion gases and particulate emission resulting from burning of coal is reduced.

In normal operation the boiler is operated by having the base load for the boiler carried by the burning of the coal, and loads above the base load being carried by the oil or gas flame. As the percentage of oil or gas burned relative to the percentage of coal burned is increased, the particulate emission decreases. When the percentage of oil or gas becomes about 25% to 30%, the particulate emission is reduced to its lowest level, that of oil, and remains at that level with increased percentages of oil or gas. Thus, a boiler has been made having the particulate emission characteristics of oil, but burning about 70% to 75% coal.

For those situations in which the demand is relatively constant, the boiler is best and most efficiently operated with the base load of coal providing about 70% to 75% of the total BTU input.

THE DRAWINGS

FIG. 6 is a vertical section, taken on line 6—6 of FIG. 4, showing details of the automatic stoker, the location of the gas or oil burner in the rear wall, and the fire tubes in the boiler.

DETAILED DESCRIPTION OF THE INVENTION

Figure 1:
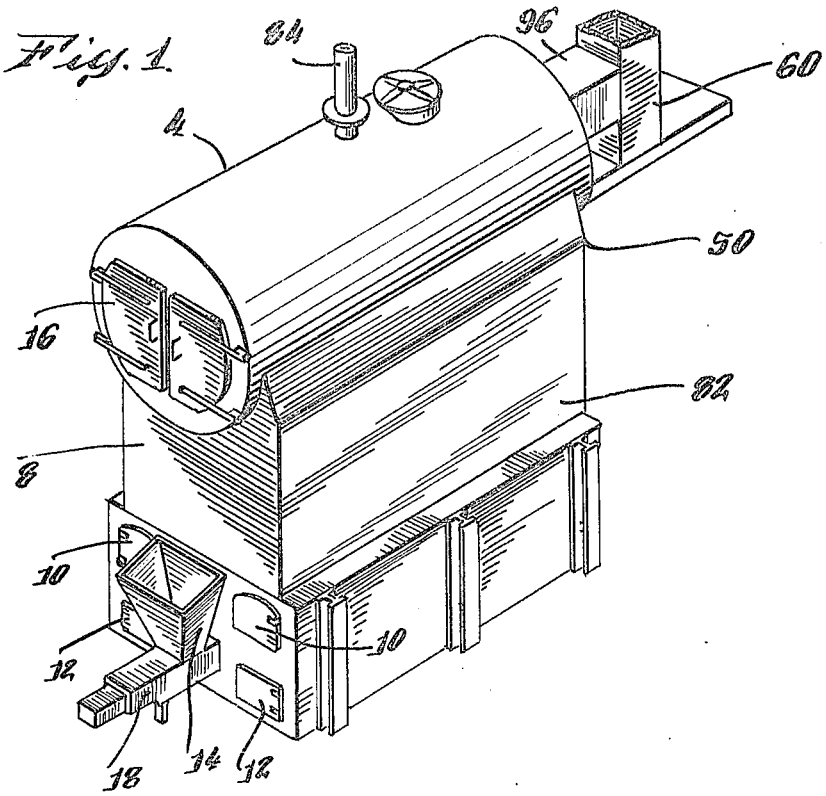
FIG. 1 is a perspective of the boiler of this invention. It shows the fire-tube section taken at the top and the combustion chamber below it.
Figure 2:
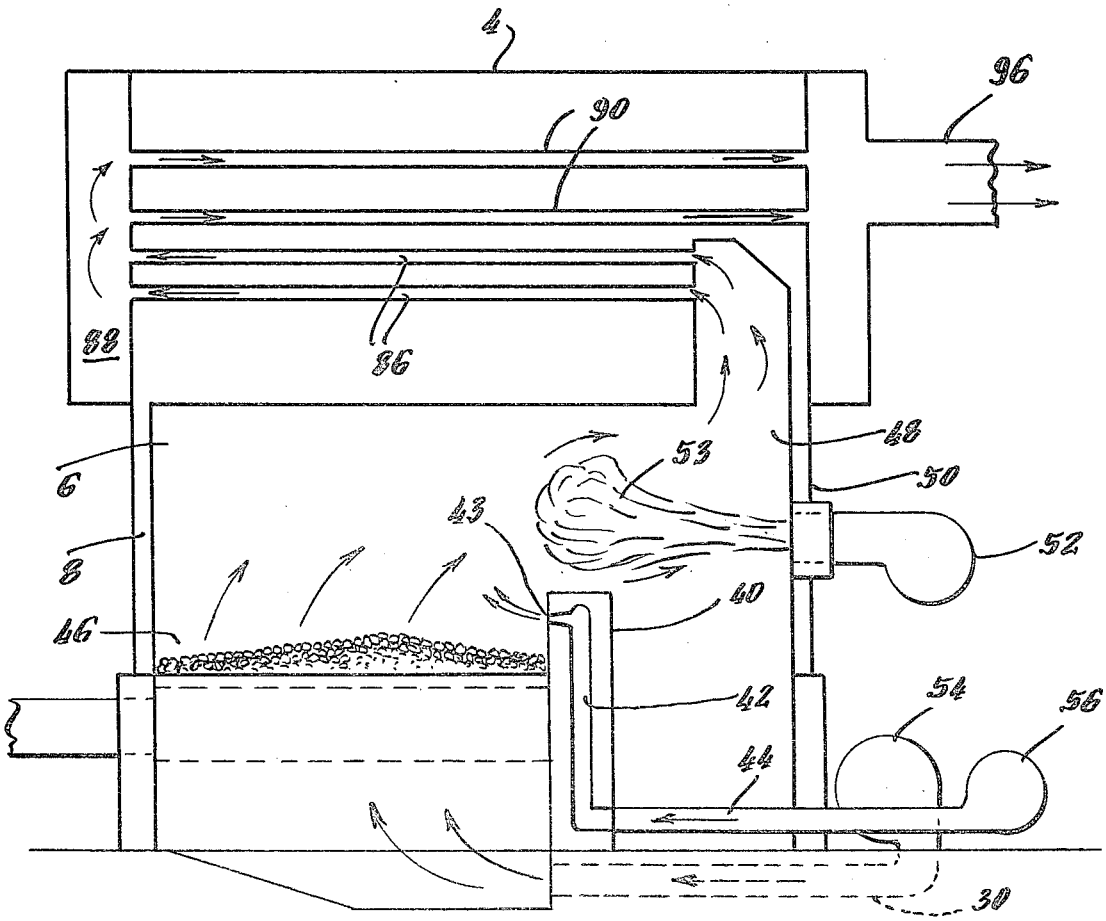
FIG. 2 is a longitudinal section through the unit showing gas flow patterns.
Figure 3:
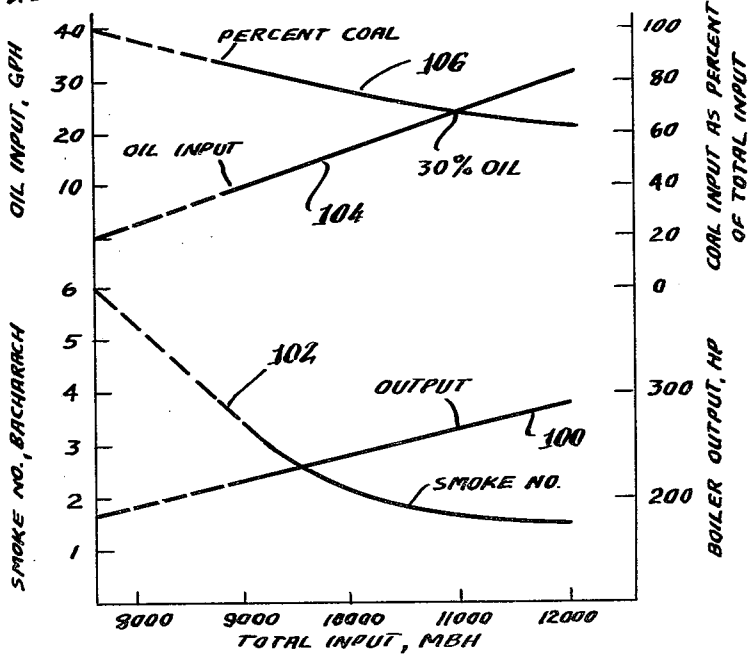
FIG. 3 is a graph showing operating results in one typical boiler. In particular it shows how the Bacharach smoke number rapidly drops as a counter-flame of oil is burned.

A perspective view of the industrial boiler of this invention is shown in FIG. 1. Details are given in the other Figures; and FIG. 3 is a graph showing the rapid and substantial reduction in particulate emission of the boiler when a relatively small percentage of oil is burned simultaneously with coal using the particular structure and method of this invention.

As shown in FIG. 1, the boiler comprises a pressure vessel 2 which includes fire-tube section 4, waterlegs 82, front wall 8, and rear wall 50.

Figure 5:
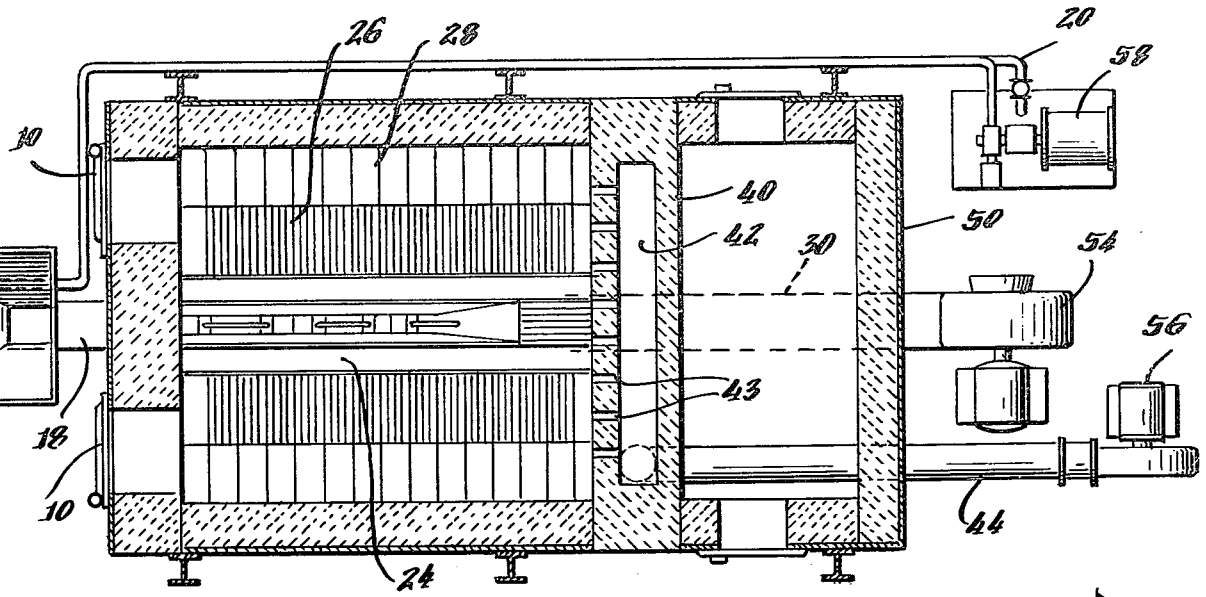
FIG. 5 is a horizontal section, taken on line 5—5 of FIG. 4, showing the internal configuration of the coal bed and certain of the external feeding elements.
Figure 4:
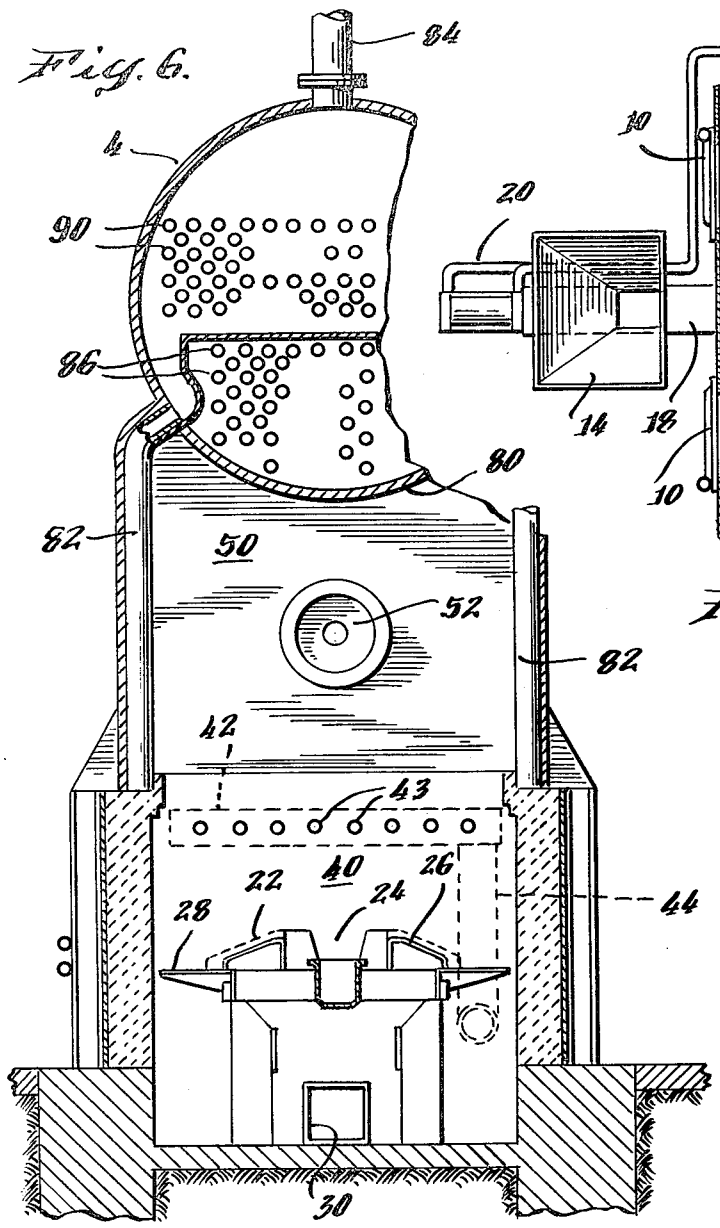
FIG. 4 is a side elevation, partially in section, showing the components of the boiler.
Figure 4:
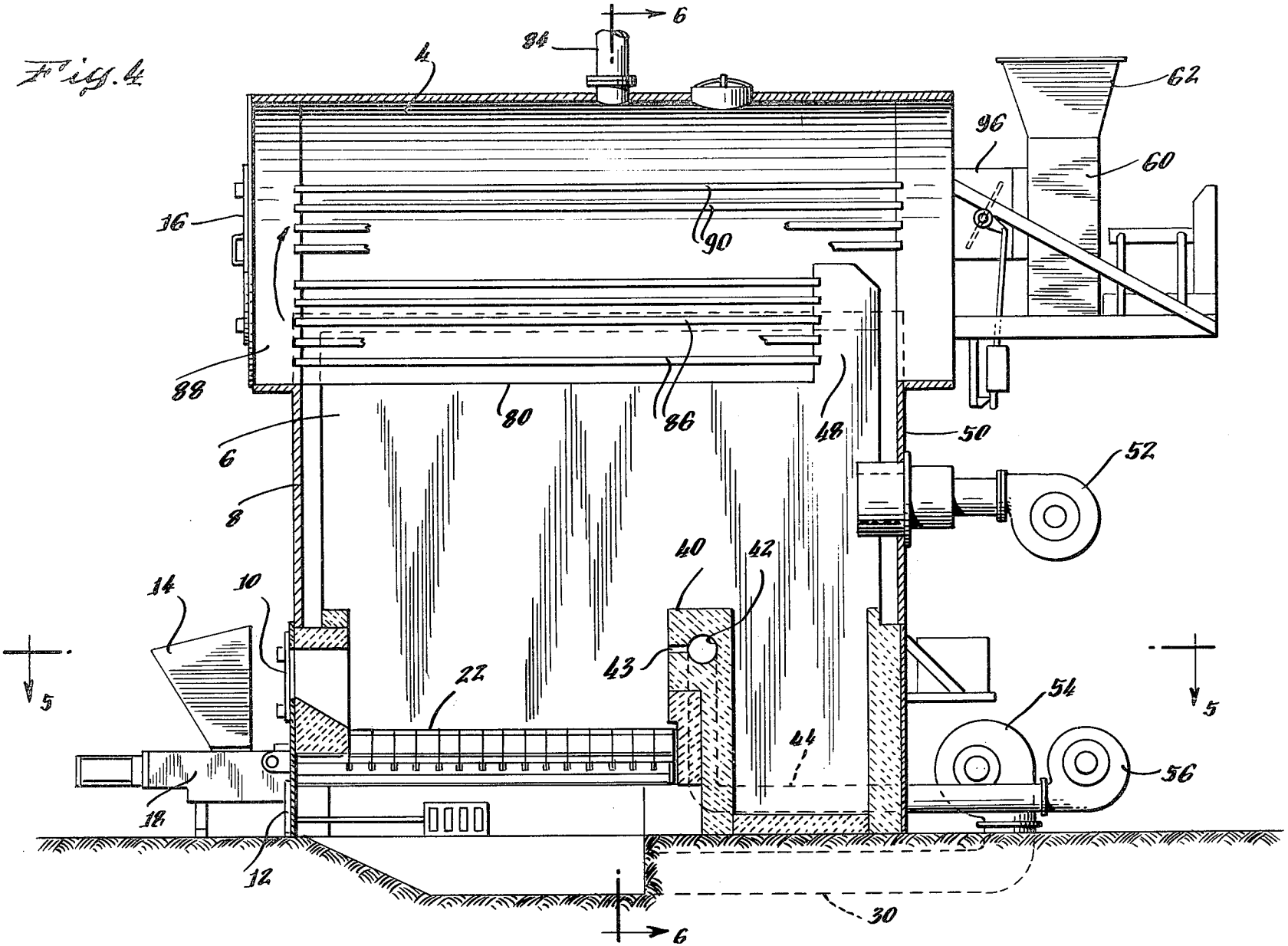

The front of the boiler is to the left in FIG. 1 and includes front wall 8, firing doors 10, ash removal doors 12, and coal-stoking hopper 14. The front of the fire-tube section 4 has flue doors 16. The rear portion of the boiler (see especially FIGS. 4 and 5) includes rear wall 50, a horizontally-directed oil or gas burner 52 mounted on rear wall 50, a stoker combustion air blower 54, an over-fire air blower 56, an hydraulic stoker control 58, an induced draft fan 60, and a combustion gas discharge 62.

Coal-Burning Portion

The coal burning portion of the boiler utilizes a hydraulic stoker 18 mounted on front wall 8 in the lower portion, and controlled by hydraulic control lines 20 leading from the hydraulic stoker control 58. The stoker may be operated at different fuel consumption rates.

Coal-burning grate 22 consists of retort 24 to receive coal from the stoker, stoker tuyeres 26 adjacent the retort section and dump plates 28 outside the tuyeres 26 to be used for periodically dumping the ash into the lower portion of the boiler, so that it may be removed through ash removal doors 12. A combustion air duct 30 is connected to stoker combustion air blower 54 to provide air beneath grate 22, which then passes through the coal 46 for combustion purposes. At the end of the grate is bridge wall 40 extending above grate 22 to contain the coal and to provide horizontally-directed over-fire air. Bridge wall 40 includes an over-fire air manifold 42 with horizontally-directed outlet nozzels 43. Manifold 42 receives its supply of air through air inlet duct 44 connected to over-fire air blower 56.

The outlet for combustion gases from combustion chamber 6, flue gas exit 48, is the entrance to the lower fire-tubes. The flue gas exit 48 is positioned to the rear of bridge wall 40 adjacent to the back wall 50, and above the place in back wall 50 where burner 52 enters combustion chamber 6. (It will be noted that burner 52 is positioned to direct its flame 53 above the top of bridge wall 40.) As a result, the coal combustion gases must pass at an angle from the vertical through combustion gas passage 51 to reach flue gas exit 48.

Since the BTU output of a coal fire cannot be varied as rapidly as that of an oil or gas flame, the coal fire is used to provide the base load, and the gas or oil flame is used for modulation and to reduce particulate emission.

In operating the coal-fired portion of the boiler, the hydraulic stoker control unit 58 actuates hydraulic stoker 18 through control lines 20; and coal, fed through hopper 14, is forced inwardly to grate 22. The coal burns primarily on stoker tuyeres 26, which have openings in them to receive combustion air from below from combustion air duct 30. As the coal burns, it is forced outwardly over dump plates 28 which may be dropped periodically to remove the ash. Bridge wall 40 is positioned to the rear of grate 22, and provides over-fire air through nozzles 43.

The combustion gases from the burning of the coal then pass through combustion gas passage 51 out of combustion chamber 6, and through flue gas exit 48. As will be described below, however, the passage of the combustion gases from grate 22 to flue gas exit 48 can be usefully affected by the operation of burner 52.

The Oil and Gas Burning Portion

As mentioned above, oil or gas burner 52 is mounted on the rear wall 50, and so positioned that its nozzles direct its flame 53 substantially horizontally through combustion gas passage 51 above bridge wall 40 and substantially past flue gas exit 48. Burner 52 may be a gas burner, an oil burner, or a combination oil and gas burner. It should include means to vary the rate of fuel consumption.

Burner 52 is positioned on the center-line of the rear wall 50 of combustion chamber 6 and near the top of rear wall 50, however, but sufficiently below it to permit combustion gases to pass between its flame and the bottom 80 of fire-tube section 4, to enter flue gas exit 48.

This position of burner 52 causes its flame to cut across the path of the combustion gases from the coal fire as they approach flue gas exit 48, and the flame 53 should be hot enough to support combustion of particulate matter in the coal combustion gases. These crossed paths, i.e., the path of the flame 53 from burner 52 and the path of the combustion gases from the coal, have several effects. First, they create a turbulence in the combustion gases, which serves to delay the exiting of the coal combustion gases and to create further combustion time. Second, the flame from burner 52 provides heat to the coal combustion gases which will enable further combustion. (The Boiler is, in accordance with the usual boiler practice, always operated with excess air.) Third, the force of the flame from burner 52 tends to direct not only its own combustion gases, but also the combustion gases from the coal, toward the front of the combustion chamber 6; this adds further time delay for additional combustion.

Burner 52 should be of such size and capacity that its flame pressure is sufficient to cause the coal combustion gases to move in a direction away from flue gas exit 48.

Pressure Vessel

Pressure vessel 2 is of the fire tube type in which the hot products of combustion pass through fire tubes positioned within the water to be heated. The lower outer surface of the fire-tube section, the crown 80, forms the upper wall of combustion chamber 6. Fire-tube section 4 is supported by water legs 82, through which the incoming water passes. Water legs 82 partially form the inner sides of the combustion chamber 6 for pre-heating incoming water. After the water is heated in fire-tube section 4, the water (or water and steam) leaves through water outlet 84.

Positioned within the fire-tube section 4 are two series of horizontal fire tubes for carrying the heated combustion gases for heat exchange to the water. There is a first series of parallel lower fire tubes 86, which receive the hot combustion gases from flue gas exit 48 at the rear of the crown. These heated gases pass through lower fire tubes 86 to a reversing chamber 88 at the front of fire-tube section 4. A second series of parallel fire tubes 90, the upper fire tubes, are within fire-tube section 4 and above lower fire tubes 86.

After passing through tubes 86, the combustion gases are reversed in the reversing chamber 88, and then pass through upper fire tubes 90. The gases then pass through duct 96 to induced draft fan 60 and out combustion gas discharge 62. Fan 60 creates about 0.15 to about 0.2 inches of water negative pressure in the combustion chamber in order to draw out these gases.

Operation of the Boiler and Combustion Gas Interaction

Aside from economic consideration, coal-fired boilers of the past have suffered from three technical problems:

(a) Coal fires are difficult to modulate quickly to match heating load requirements;

(b) Coal fires are typically dirty, with high levels of particulate emission;

(c) Particulate deposit on boiler heating surfaces decreases normal efficiency, while increasing maintenance costs; (coal-fired boilers produce a less than desired level of thermal efficiency).

The boiler of this invention uses a base load of coal at the input desired by the user, and then provides a modulating gas or oil fire to balance the boiler output to match the heating load. Both combustion processes operate at a relatively constant excess air, providing relatively constant thermal efficiency over varying ranges of load demand.

When both coal and gas or oil are being used, the coal is stoked from the front of the boiler, and the burner is fired from the rear of the boiler. Hot flue gas from the coal bed rises through the combustion chamber toward the flue gas exit. The burner flame is under the flue gas exit and so the coal flue gas must pass through the gas or oil flame to exit from the combustion chamber. At the same time, hot flue gas from the oil or gas flame appears to pass over the coal bed and reverse direction towards the front of the combustion chamber, traveling along the crown 80 of the boiler to flue gas exit 48.

These two "crossing" gas flows apparently serve to interact and create a vector flow, which is the sum of the two individual flows. This, it would appear, results in a turbulence within combustion chamber 6 and results in the coal flue gas being directed first to the front of the burner, and then up underneath crown 80 of fire-tube section 4. Thus, there is a delay in the passage of the coal flue gas to flue gas exit 48. This delayed gas is at combustion temperatures (due to the oil or gas flame) and includes excess air. Consequently, it is believed, particulate matter in the coal combustion gases is burned before entering flue gas exit 48.

It has been found that utilization of the flame from burner 52 not only increases the efficiency of combustion and allows modulation, but also decreases particulate emission from the burning coal.

In one example, tests were made in a boiler rated at 250 hp on coal alone (rated 300 hp with coal and gas or oil, or just oil and gas alone). When used in combination with coal, the oil burner was not used above a 106 hp rating. The grate size was based upon the proposed burning of 35 pounds of coal per hour per square foot of grate and the total volume of the combustion chamber was such there would be heat release no greater than 35,000 BTU per cubic foot per hour.

In an experiment directed to determining particulate emission, the stoker was operated at a fixed rate to provide 602.8 pounds of coal per hour; and oil input to the burner was varied from 10 to 31.8 gallons per hour. Bacharach smoke spot testing procedures were used. When coal alone was burned, the Bacharach test number was 6. As oil was burned in increasing quantities, the Bacharach test number rapidly decreased. When the oil input reached approximately 20 gallons per hour, the test number levelled off and ceased decreasing. The coal used had 12,582 BTU per pound, and the oil 139,076 BTU per gallon; thus, it was found that when approximately thirty percent of the BTU input was from oil, and seventy percent from coal, the Bacharach smoke number for the entire emission was at a low and steady level. This level was equivalent to, or lower than, the number which is the accepted standard for efficient burning of the oil alone. The thermal efficiency of the total unit was approximately eighty percent.

Thus, by burning a sufficient percentage of oil with coal in the manner of this invention, it is possible to burn substantial quantities of coal and yet have good particulate emission levels, i.e., the advantages of oil are obtained even though coal is burned. In this particular example the Bacharach smoke number was reduced to about 1.5, even though the accepted industry standard is 2.

The results of this experiment are plotted in the curves shown in FIG. 3 against the total input in thousands of British thermal units per hour (MBH). Line 100 in the graph represents the total boiler output from combustion of both coal and oil. Curve 102 is the Bacharach smoke test number. It represents 6 at the left end of the graph, and drops quickly down to the asymptotic level of 1.5. Curve 104 shows the increasing oil input in gallons per hour. Curve 106 represents the percentage of coal burned as the percentage of the total BTU input.

As mentioned, Curve 102 which shows smoke number, very quickly levels off as oil input is increased. (Curve 102 is dotted at the left portion representing areas not tested, because the oil burner used was not designed to operate below a rate of about ten gallons per hour.) These curves show that the accepted industry standard of a Bacharach number of 2.0 can be achieved if 25% oil is used and 75% coal. Increasing that percentage slightly to approximately 30% oil serves to reduce the Bacharach number to about 1.5, at which point the curve levels off. No significant further particulate reduction is thereafter gained in terms of particulate reduction by using higher percentages of oil, though, it should be noted, that a 1.5 number is 25% better than the industry standard for either coal or oil.

Accordingly, it is seen that a fire-tube boiler has been produced which efficiently burns coal and, at the same time, reduces particulate air pollution and increases thermal efficiency.

We claim:

1. A boiler adapted to burn coal with reduced particulate emission, said boiler including a combustion chamber and a fire-tube section, said combustion chamber being positioned below said fire-tube section and having a flue gas exit at one end thereof to discharge hot combustion gases from said combustion chamber, said combustion chamber including a coal-burning area and a combustion gas passage from said coal-burning area to said flue gas exit, said coal-burning area being beneath a major portion of said fire-tube section but not directly beneath said flue gas exit, whereby passage of coal combustion gases from said coal-burning area through said combustion gas passage is at an angle from the vertical, said combustion chamber further including an oil or gas burner removed from said coal-burning area positioned at the opposite end of said combustion chamber from said coal-burning area and below and proximate to said flue gas exit, said burner being directed so that its flame extends horizontally through said combustion gas passage toward the end of the combustion chamber having said coal-burning area, past said flue gas exit, across the path of said coal combustion gases, whereby the direction of the flame from said burner opposes the direction of flow of said coal combustion gases and particulate emission resulting from burning of coal, and means for varying the relative quantities of coal and oil or gas being burned.

2. A boiler as in claim 1 in which said burner is of sufficient capacity relative to the capacity of said coal-burning system to reduce the particulate emission rate of said boiler to a rate approximating that of the oil used in said burner.

3. A boiler as in claim 1 in which said particulate emission is no greater than Bacharach smoke test number 2 when said means for varying said relative quantities of coal and oil is set so that the BTU input to the boiler contains no greater than 30% BTU from said oil.

4. A boiler as in claim 1 in which said burner has sufficient flame pressure to cause said coal combustion gases initially to pass in a direction away from said flue gas exit.

5. A boiler as in claim 1 in which said fire-tube section includes a series of reversing fire tubes.

6. A boiler as in claim 1 in which said fire-tube section includes supporting water legs connecting a source of water to be heated to the interior of said fire-tube section, said water legs forming at least a portion of the sides of said combustion chamber whereby said water may be pre-heated.

7. A boiler as in claim 1 including an induced draft fan associated with said flue gas exit from said combustion chamber for drawing said flue gas out under negative pressure.

8. An boiler adapted to burn coal with reduced particulate emission, said boiler including a combustion chamber and a fire-tube section, said combustion chamber positioned below said fire-tube section and having a flue gas exit at one end thereof to discharge hot combustion gases from said combustion chamber, said combustion chamber including a coal-burning area and an oil or gas burner, said coal-burning area being beneath a major portion of said fire-tube section but not directly beneath said flue gas exit, whereby passage of coal combustion gases from said coal-burning area is at an angle from the vertical, said burner being positioned at the opposite end of said combustion chamber from said coal-burning system and below and proximate to said flue gas exit, said burner being directed so that its flame extends horizontally toward the end of the combustion chamber having said coal-burning system and across the path of said coal combustion gases, said flame being so directed with sufficient force to cause said combustion gases to be diverted and directed away from said outlet to provide additional combustion time, and means for varying the relative quantities of coal and oil or gas being burned.

9. The boiler of claim 8 in which said burner is of sufficient capacity relative to the capacity of said coal burning system to reduce the particulate emission rate of said boiler to a rate approximating that of the oil used in said burner.

10. The boiler of claim 8 in which said particulate emission is no greater than Bacharach smoke test number 2 when said means for varying said relative quantities of coal and oil is set so that the BTU input to the boiler contains no greater than 30% BTU from said oil.

* * * * *